US008112892B2

(12) United States Patent
Haczek et al.

(10) Patent No.: US 8,112,892 B2
(45) Date of Patent: Feb. 14, 2012

(54) HAIR REMOVAL APPARATUS

(75) Inventors: Werner Haczek, Idstein (DE); Thorsten Piesker, Bad Homburg (DE); Markus Sabisch, Idstein (DE)

(73) Assignee: Braun GmbH, Kronberg (DE)

( * ) Notice: Subject to any disclaimer, the term of this patent is extended or adjusted under 35 U.S.C. 154(b) by 697 days.

(21) Appl. No.: 12/066,452

(22) PCT Filed: Aug. 10, 2006

(86) PCT No.: PCT/EP2006/007920

§ 371 (c)(1),
(2), (4) Date: May 9, 2008

(87) PCT Pub. No.: WO2007/033728

PCT Pub. Date: Mar. 29, 2007

(65) Prior Publication Data

US 2008/0209735 A1 Sep. 4, 2008

(30) Foreign Application Priority Data

Sep. 16, 2005 (DE) ..... 10 2005 044 176

(51) Int. Cl.
*B26B 19/02* (2006.01)
*B26B 19/00* (2006.01)

(52) U.S. Cl. ..... 30/50; 30/32

(58) Field of Classification Search ..... 30/43.91, 30/208, 196, 43, 43.3, 43.7–43.9, 50, 32
See application file for complete search history.

(56) References Cited

U.S. PATENT DOCUMENTS

| | | | | |
|---|---|---|---|---|
| 2,127,881 | A * | 8/1938 | Morris | 30/32 |
| 2,794,247 | A * | 6/1957 | Negromanti | 30/43.2 |
| 3,137,940 | A * | 6/1964 | Curci | 30/40 |
| 3,186,087 | A | 6/1965 | Kahn | |
| 4,617,736 | A * | 10/1986 | McCrary | 30/169 |
| 4,688,329 | A * | 8/1987 | Oord | 30/43.6 |
| 4,916,814 | A * | 4/1990 | Althaus | 30/40.2 |
| 5,165,172 | A | 11/1992 | Weinrauch | |
| 2003/0221319 | A1 * | 12/2003 | Iwashita et al. | 30/43.92 |
| 2004/0128834 | A1 | 7/2004 | Royle | |
| 2005/0188540 | A1 * | 9/2005 | Kelly et al. | 30/45 |

FOREIGN PATENT DOCUMENTS

| | | |
|---|---|---|
| AT | 327 735 | 2/1976 |
| DE | 36 10 736 | 10/1987 |
| DE | 90 14 307 | 4/1991 |
| DE | 198 45 648 | 4/1999 |
| DE | 198 59 017 | 2/2000 |
| DE | 102 42 091 | 4/2004 |
| DE | 102 42 094 | 4/2004 |
| EP | 0 176 128 | 9/1985 |
| EP | 0 403 315 | 2/1990 |
| FR | 2632886 | * 12/1989 |
| WO | WO2004/033164 | 4/2004 |

* cited by examiner

*Primary Examiner* — Phong Nguyen
(74) *Attorney, Agent, or Firm* — Kelly L McDow

(57) ABSTRACT

A hair removal apparatus with a housing and an actuator head movable in the housing. The actuator head accommodates an actuator system that removes the hairs and is adapted to be driven by an electric drive mechanism arranged in the hair removal apparatus. The actuator system is movable into at least one active position for hair treatment. The actuator head has only one of its ends rotatably mounted on the housing. The actuator head is readily accessible from the one side, thus enabling hairs in problem areas of the skin surface to be removed.

6 Claims, 5 Drawing Sheets

Fig. 3
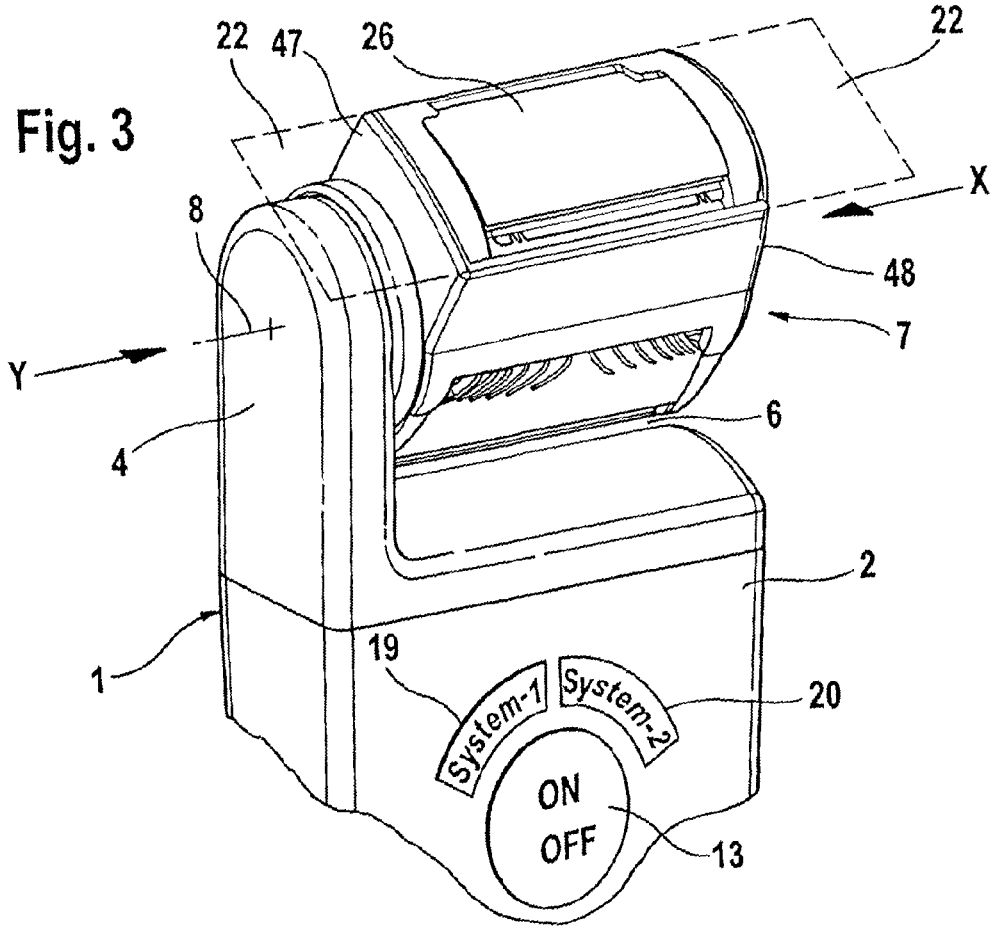
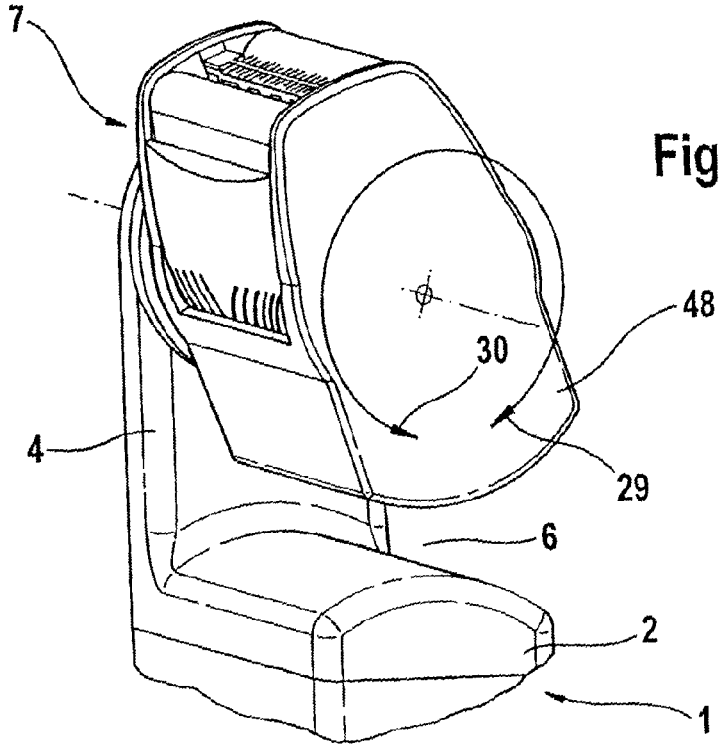
Fig. 4

HAIR REMOVAL APPARATUS

TECHNICAL FIELD

This invention relates to a hair removal apparatus.

BACKGROUND

From DE 36 10 736 A1 there is known a hair removal apparatus, in this case an electrically driven shaving apparatus, on which an actuator head, in this case a short-hair cutter, is movably fastened to the housing. The short-hair cutter includes two shaving foils that extend essentially parallel to the axis of rotation of the actuator head and under each of which respectively one oscillating under cutter with individual sheet-metal disks is slidingly arranged. On said electric shaving apparatus, the short-hair cutter forms the only actuator system.

From DE 198 59 017 C1 there is known in addition a hair removal apparatus which is constructed as a hair clipper and on which the actuator head includes two different actuator systems. In this arrangement, two cutting blades are assigned to a single clipper comb and can be coupled, respectively according to the pivot position of the actuator head relative to the housing, to a drive element of the drive mechanism. In this way the clipper comb, which has two rows of cutting teeth, can be brought by means of a pivot movement into an optimum cutting position relative to a skin surface.

The construction of two cutting blades on one clipper comb also enables in advantageous manner a different construction of the teeth on the clipper comb and the teeth on the two cutting blades, for example in that the width of one row of cutting teeth is constructed substantially smaller than the width of the other row of cutting teeth. As the result it is possible, for example, to cut long hair with the one row of cutting teeth and short hair with the other row of cutting teeth. To make this possible, the actuator head must be pivoted about a pivot axis which in this case lies outside the clipper comb. According to FIGS. 6 and 7 of DE 198 59 017 C1, the cutting teeth row 41 thus comes to rest on the housing 1 and is inactive in this position while the cutting teeth row 40 according to FIG. 7 now projects freely outward and can make contact with the skin. According to FIG. 6, the cutting teeth row 41 had adopted its active position, meaning its shaving position, and the cutting edge 40 its rest position before the actuator head was pivoted. Since the pivot axis lies outside the clipper comb, said comb is rotatable only to a limited degree in the housing. Mounting the clipper comb in the housing is relatively elaborate and expensive.

With this hair clipper, the apparatus must also be turned in the hand when switching from the one clipper comb to the other clipper comb because the direction of the cutting plane is also shifted from the one side of the housing to the other. Consequently, the electric switching device is moved from the outside, where it was easy to actuate with the thumb, to the inside of the hand where it is therefore no longer easy to reach.

SUMMARY

One aspect of the invention features a hair removal apparatus with an overhung mounting of the actuator head on the housing. Because the actuator systems are freely accessible from the one side of the actuator head, the individual actuator systems can be approached to the skin surface from the free end of the actuator head with particular ease, and this on particularly hard-to-reach areas such as behind the ear or on the sides of or underneath the nose. The overhung-mounted actuator head provides not only a hair treatment apparatus of novel appearance compared to the state of the art, but also affords technical advantages and advantages for everyday use. Furthermore, the overhung mounting of the actuator head in the housing enables a better cleaning operation to be accomplished because the actuator head is more easily accessible. Also the actuator head mounts and demounts more readily since there is only one mounting point where it has to be mounted or demounted.

The hair removal apparatus has a simple housing design. The overhung mounting arrangement is combined with a mounting stable enough for the bending forces acting on the actuator head when placed against a user's hair surface to be absorbed by the mounting without damage.

In one implementation, the receptacle for accommodating the actuator head in the housing can be kept within minimum limits. A small receptacle is achieved if the axis of rotation of the actuator head extends centrally to the actuator systems and the actuator systems are built to small dimensions.

In some implementations, the axis of rotation of the actuator head extends in the longitudinal direction of the treatment planes of the individual actuator systems, i.e., essentially parallel thereto, thus resulting in particular ease of handling of the hair removal apparatus. Like a rotating drum, the actuator head can be turned about its axis of rotation until the corresponding actuator system, for example a short-hair cutter, points radially outwards away from the hair removal apparatus, i.e., its treatment plane extends perpendicular or at an angle to the longitudinal axis of the housing and, in addition, substantially parallel to the axis of rotation. An actuator system can be easily moved against the hair surface to be treated without the housing getting in the way.

With a bearing arm protruding from the housing, the actuator head can be adapted to form a freely cantilevered element particularly well. In this arrangement, a receptacle is formed between the bearing arm and the housing for receiving the actuator head, so that with a well-balanced dimensioning of the actuator head it does not protrude beyond the sides of the housing. This also protects the cutting systems largely from external damage when the hair treatment apparatus is placed down on a hard surface. The provision of additional walls on the housing which project in the direction of the bearing arm protects the sides of the actuator head therebetween while yet ensuring free accessibility both from the one side and from above.

Because the actuator head forms a rotary body and is therefore freely rotatable about an axis of rotation in the housing of the hair removal apparatus, the entire circumference of the actuator head can be used for providing two or more actuator systems, each of which reaches the required hair treatment plane respectively once during one rotation of the actuator head through 360°. At the same time the apparatus can be held in the same position without any change of position by the hands. In some embodiments, stops on the actuator head limit rotation in the housing through an angle smaller than 360°.

Through the circumferential construction of the individual actuator systems on the actuator head, the actuator head in its simplest embodiment takes on a roller or drum-shaped form, whereby the axis of rotation of the actuator head also extends in the longitudinal direction of the individual actuator systems. If only two actuator systems are provided on the actuator head, said systems are advantageously arranged in diametrically opposite positions and the actuator head takes on the form of a right parallelepiped whose circumferential end faces are slightly curved outwards in order to produce better contact with a user's skin.

Many combinations of actuator systems on the actuator head of a hair treatment apparatus are possible, as, for example, any combinations of long-hair cutter, medium-hair cutter, short-hair cutter, beard trimmer, epilators, etc.

With the overhung mounting of the actuator head, a bearing journal projects from the end for close-fitting engagement with a bore constructed on the housing where the journal is fixedly located. In this arrangement the journal and the bore combine to form a closely toleranced slide fit in which the actuator head can be turned free of play. It is possible to select, for example, snap rings or other clip fasteners as fixing elements for fixing the actuator head via the journal in the housing.

In some embodiments, the actuator head is turned by hand about its axis of rotation in order to move a desired hair treatment system into the active position of the actuator head. In some cases, provision is made between the actuator head and the housing for detent means which indicate to a user when the desired actuator system has adopted its correct position relative to the housing and a shaving or plucking operation can be started. Thereafter the actuator head can be moved into its rest position, which can also be done automatically by the apparatus itself after the apparatus is switched off. At the same time the actuator head is locked against rotation in order to prevent the actuator head from being turned accidentally during a hair treatment operation.

As another alternative for adjusting the actuator head it is possible to use for the actuator head an electrically driven adjusting unit which with each actuation of the switch for the adjusting unit turns the actuator head until the switch is switched off again. It is also conceivable for the electric adjusting unit to turn, with each actuation of the switch, the actuator head until the next actuator system is moved into its operating position.

In some embodiments, the electric adjusting device includes an electrically driven motor which is provided in addition to the cutting system and turns, via a transmission device, the actuator head into the desired active position. In this arrangement, the transmission device includes a gearwheel arrangement between the drive motor and the actuator head, whereby the bearing journal can then be constructed simultaneously as a gearwheel which is coupled via a gearwheel connected to the drive shaft of the drive motor. However, it is also conceivable to provide a toothed belt which connects the drive shaft of the electric motor to the bearing journal. Also possible of course are transmission belts or other transmission units for transmitting the torques. And of course it would certainly be conceivable for the drive motor to be coupled directly to the journal of the actuator head in order to dispense entirely with the transmission device.

In some implementations, the hair removal apparatus includes an electric position detector which detects the rotary position of the actuator head and sends corresponding signals to an electronic controller provided on the printed circuit board. The electronic controller in turn actuates the drive mechanism when the position of the actuator head desired by an operator is to be changed.

Actuator heads may include, for example, a short-hair cutter in the form of one or two foils and a cutter engaging the foil(s) from underneath, a center cutter, a long-hair cutter or a plucking device for plucking hairs, which are provided circumferentially on the actuator head and driven by at least one or more drive mechanisms. In addition the actuator head can be equipped with a parking position such that when the actuator head is turned into this plane, all existing actuator systems are deactivated. The rest position can also be an advantage in particular when the hair treatment apparatus is inserted in a cleaning center for cleaning the actuator head; by providing one or more slits in the guard surface they could then be used as inlets and outlets for the cleaning fluid.

Hence the actuator systems are not activatable in the rest or parking position. They can be activated, however, when the actuator head was inserted in a cleaning center for cleaning purposes.

A drive mechanism for the actuator head can include a linear motor that is accommodated in the interior of the actuator head. Compared to conventional rotary electric motors, linear motors have the advantage of dispensing with transmission devices and of being able to transmit the oscillating movement directly onto the actuator system. Such linear motors can be well integrated in the actuator head because they can be built to particularly small dimensions.

A water-tight linear motor is disclosed that is particularly easy to manufacture and is mounted on both side walls of the actuator head in oscillatory manner. Preferably on a hair cutting system, the linear motor sets the system in oscillation such that the under cutter moves relative to the outer cutter or the blade block moves relative to the shaving foil in order thus to be able to cut off hairs that penetrate between the cutting edges. It will be understood, of course, that the drive mechanism could also be used on epilators.

In some implementations, a simple linear motor is provided that affords economy of manufacture and can be integrated in the actuator head of a hair removal apparatus in space-saving manner.

With the described hair removal apparatus on which the actuator head is readily accessible, hairs in problem areas of the skin surface can be removed easily. Mounting and assembly of the actuator head in the housing is straightforward and economical. At the same time, several actuator systems can be positioned in their active operating position through simple adjustment of the actuator head.

An embodiment is illustrated in the accompanying drawings and will be described in more detail in the following.

DESCRIPTION OF DRAWINGS

FIG. 3 is a perspective partial view of part of the housing and the entire actuator head of FIGS. 1 and 2, showing the actuator head turned about its axis of rotation such that a second cutting system, namely a long-hair cutter, has been moved into the active position in lieu of the cutting system occupying the active position in FIGS. 1 and 2;

FIG. 4 is a perspective view, in the direction X of FIG. 3, of the upper part of the hair treatment apparatus in the region of the actuator head, the side view in the direction X being of that side of the actuator head which is not movably mounted on the housing;

DETAILED DESCRIPTION

Figure 1:
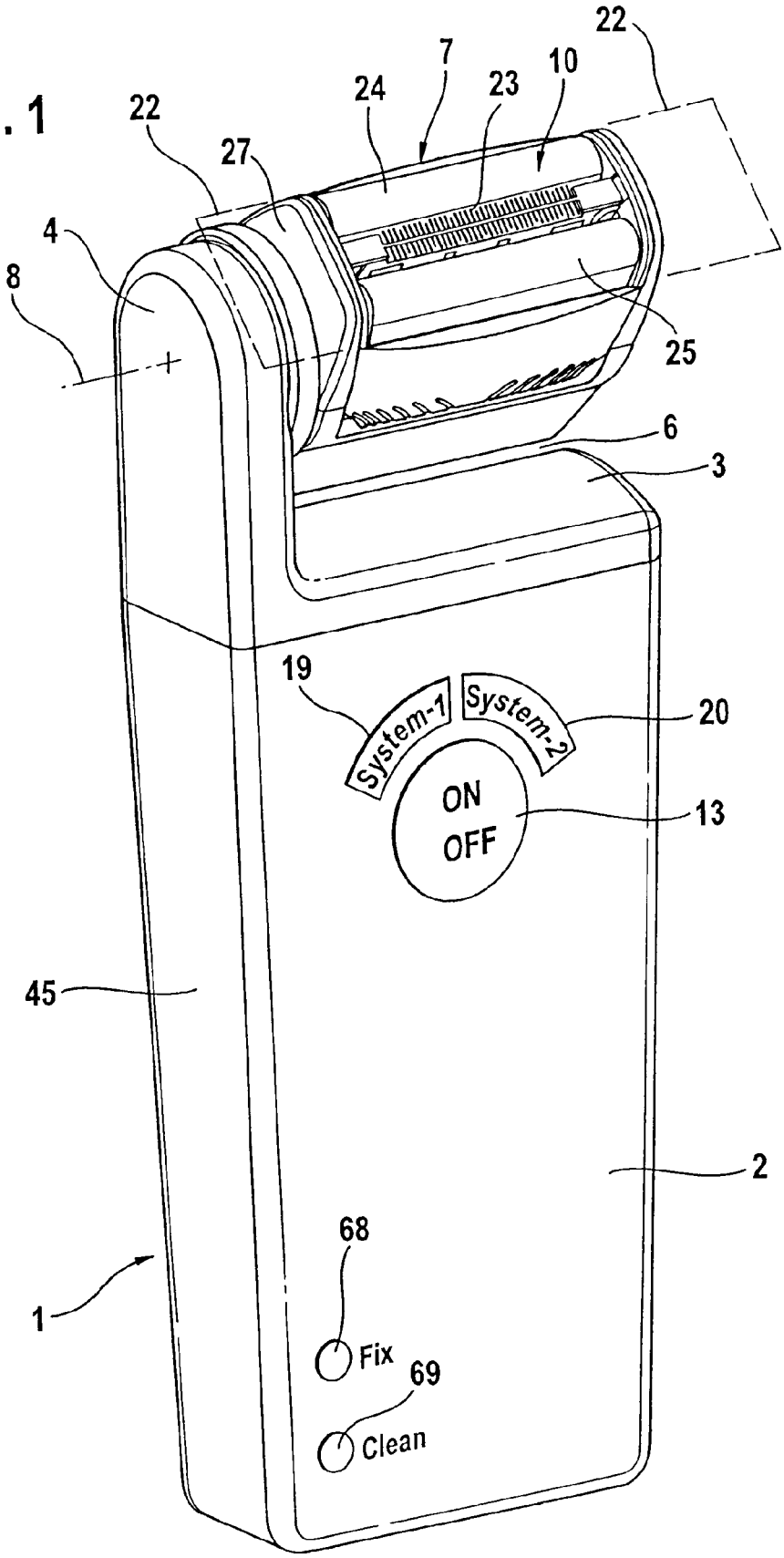
FIG. 1 is a perspective front view of a hair removal apparatus, here preferably a shaving apparatus, showing the representation on an enlarged scale and the actuator head having only one side thereof movably mounted on the housing.

The hair treatment apparatus 1 presented in a perspective view as a shaving apparatus in FIGS. 1 to 5 includes a housing 2 that merges on its upper side 3 on the left-hand edge (FIGS. 1 to 4) of the housing 2 with a single bearing arm 4 extending smoothly upwardly without forming a step. The bearing arm 4 forms with its left-hand side a common housing side wall 45 extending in a plane configuration. The width of the bearing arm 4 is about one fifth of the width of the housing 2. Between the bearing arm 4 and the upper side 3 of the housing 2 a receptacle 6 is formed which serves to accommodate an actuator head 7. In FIGS. 1 to 6 the actuator head 7 is a shaving head which however could also be replaced by an epilator head with integrated shaver part. Extending centrally to the shaving head 7 is an axis of rotation 8 that passes through the bearing arm 4. Arranged on the outer surface of the shaving head 7 in FIGS. 1 to 5 are two diametrically opposite actuator systems 10, 26 constructed as hair cutting systems, whereof the actuator system 10 is a short-hair cutter (FIG. 1) and the actuator system 26 a long-hair cutter (FIG. 3). In FIG. 6 the two actuator systems are not arranged diametrically (180°) but at right angles (90°) to one another.

In FIG. 1 the shaving head 7 has adopted the position that corresponds to the active plane 22 of the short-hair cutter 10 and of an integrated center cutter 23. Active plane 22 is understood to mean the plane which an actuator system 10, 26 has to occupy before a correct hair treatment can be performed with the apparatus 1. The short-hair cutter 10 includes two outwardly curved shaving foils 24, 25 that extend in longitudinal direction parallel to the axis of rotation 8, underneath each of which an associated under cutter is reciprocated in oscillating fashion. The same applies analogously also for the center cutter 23. The active position of the short-hair cutter 10 and the center cutter 23 is selected such that when the active plane 22 touches a user's skin surface, the housing 2 stands off obliquely or perpendicularly outwards from the skin surface and therefore is no hindrance during the shaving operation.

Figure 2:
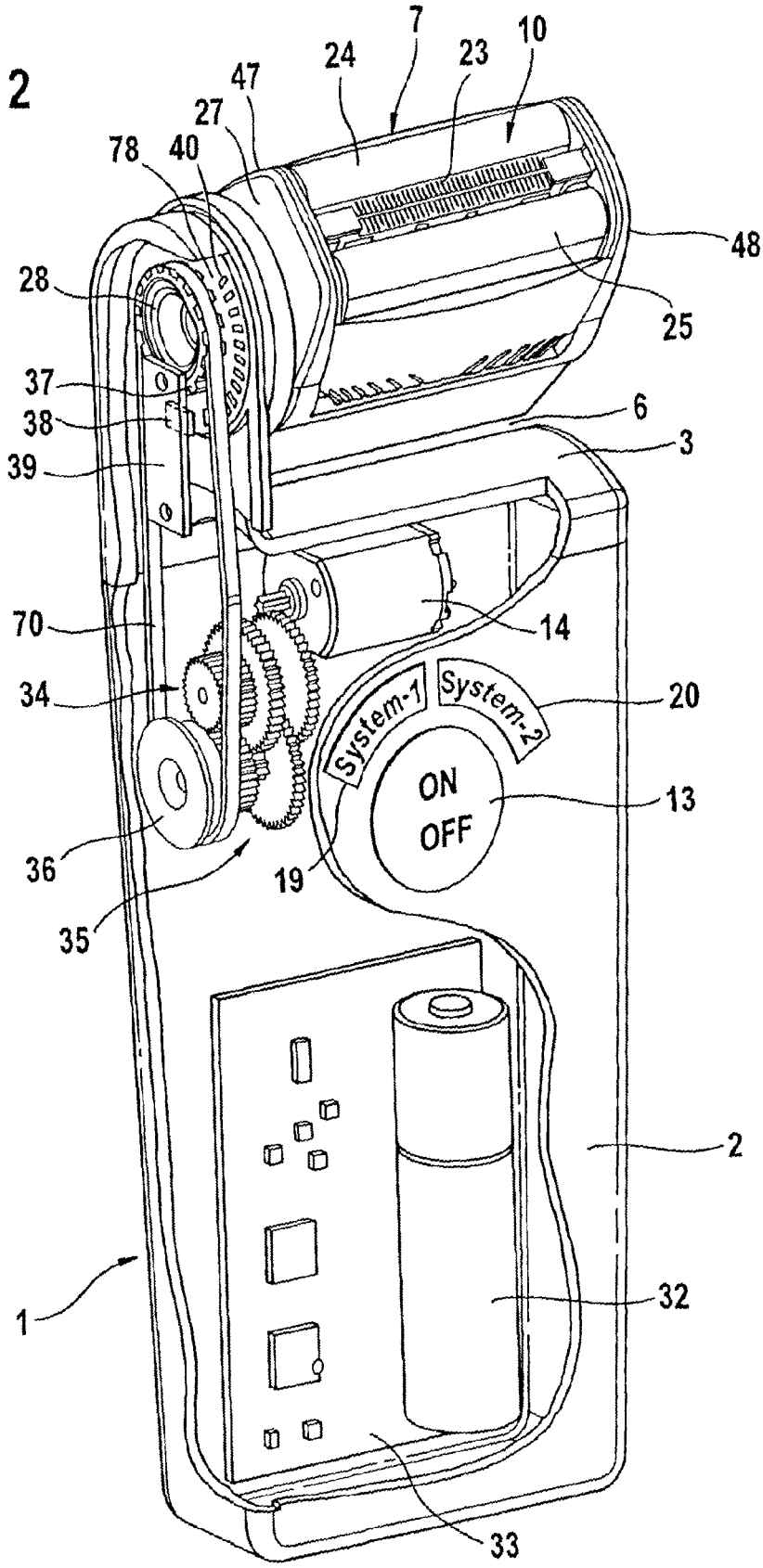
FIG. 2 is a view of the hair removal apparatus of FIG. 1 showing a partially cut-away view of the housing and the components of the actuator head drive mechanism in a schematic representation.

The shaving head 7 can be moved about its axis of rotation or bearing axis 8 either by hand or electrically, as becomes apparent from FIG. 2. If the shaving head 7 is turned about its axis of rotation 8 by hand, then it is advantageous for detent means provided between the shaving head 7 and the bearing arm 4 to lock the shaving head 7 in place as soon as the short-hair cutter 10 or the long-hair cutter 26 (FIG. 3) has reached the active plane 22. The detent means can be, for example, a spring-loaded ball which lockingly engages into a depression provided on the end face 27. Hence two depressions would be needed on the shaving head 7 for two actuator systems 10, 26.

According to FIG. 6 the shaving head 7 is rotatably mounted, via a centrally projecting bearing journal 28 on the left-hand end face 27, in a mating bore formed in the bearing arm 4, whereby the shaving head 7 of FIG. 4 can be turned in both directions of rotation 29, 30. Constructed circumferentially on the bearing journal 28 is a groove 31 that serves to fixedly locate the journal in its mating bore on the bearing arm 4. For this purpose it is possible preferably for a spring-loaded lock ring to be fastened in an annular groove in the mating bore so that when the bearing journal 28 is inserted into the mating bore, said lock ring engages in the groove 31, thereby supporting the shaving head 7 such that it is fixedly located on the bearing arm 4 but is free to rotate about the axis of rotation 8.

As the shaving apparatus 1 of FIG. 2 shows, the interior of the housing 2 accommodates an electrically driven drive motor 14 that is connected via electric leads to the switches 19, 20 for turning the actuator head 7 into the active position of the short-hair or long-hair cutting system and is adapted to be coupled via further electric connections to a storage battery 32 provided in the housing 2. The storage battery 32 is electrically controlled by a printed circuit board 33.

According to FIG. 2 the drive motor 14 is rotationally connected via a transmission device 34 to the bearing journal 28 of the actuator head 7. In this arrangement the transmission device 34 includes several meshing gearwheels 35, whereby the output-side wheel 36 serves as a belt drive and thus drives a belt 70. The belt 70 is connected to a gearwheel 37 formed on the bearing journal 28. At this point it should be noted that the teeth formed on the belt 37 on the inside and the teeth formed on the circumference of the wheel 36 are not shown in the drawing for the sake of simplicity. However, the gearwheel formed on the bearing journal 28 is shown in FIG. 2 whereas in FIG. 6 it is shown for the sake of simplicity simply as a groove but of course it also has teeth the same as in FIG. 2.

In FIG. 2 there is also fastened to a mounting plate 39 in the bearing arm 4 an electrically driven position detector 38 that registers with windows 40 provided in the end face 78 and evenly distributed over the circumference in order to stop the electrically driven drive motor 14 via electric leads when the desired actuator system 10, 26 is in the correct actuator or active plane 22.

Figure 5:
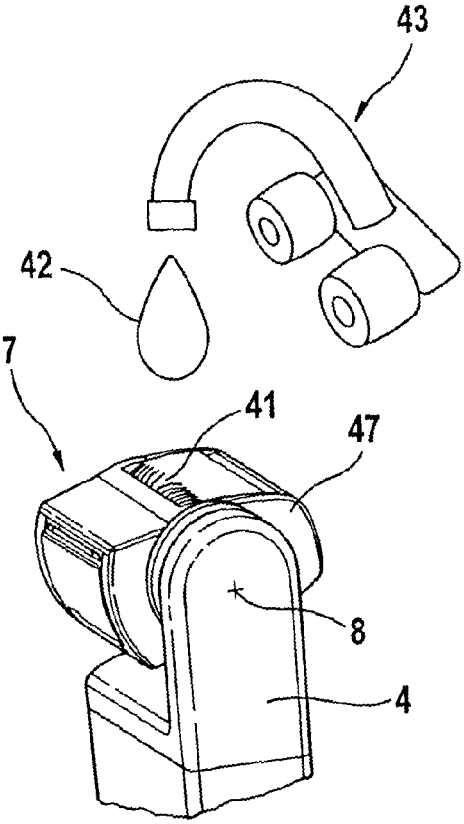
FIG. 5 is a plan view on a reduced scale from obliquely above the actuator head in the direction Y of FIG. 3, showing the actuator head turned into its cleaning position where it can be held under a water faucet (schematically shown above) for cleaning purposes.
Figure 6:
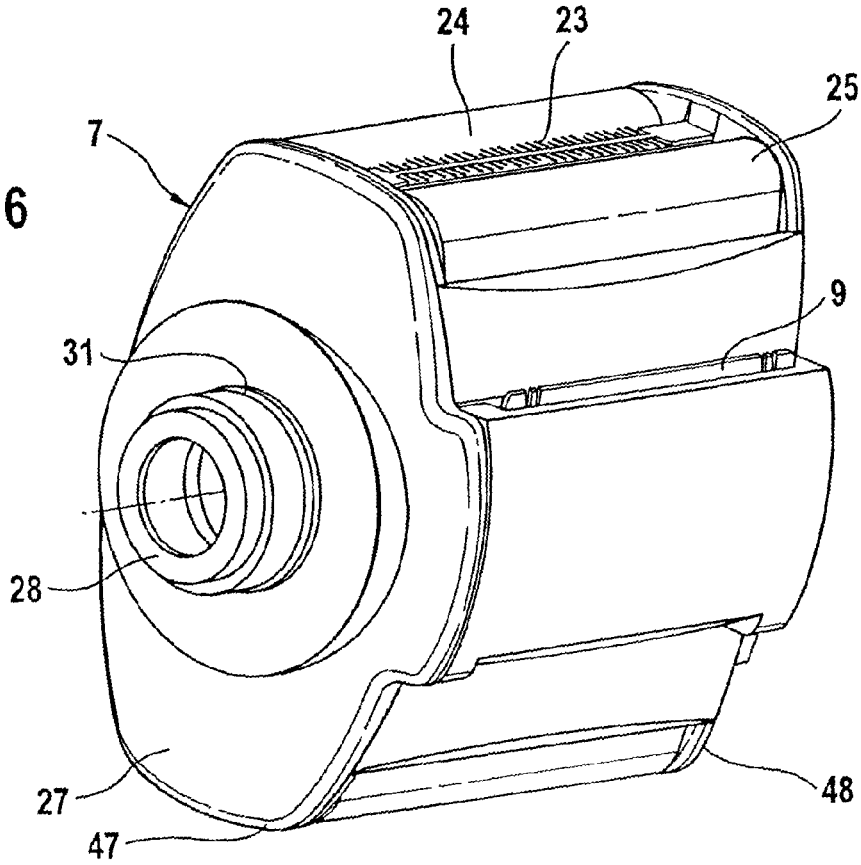
FIG. 6 is a perspective view of the actuator head itself, according to FIGS. 1 to 5, but in the demounted state and on an enlarged scale.

In FIG. 5 the actuator head 7 is shown turned to the point where a cleaning opening 41 is accessible from above so that water (represented by a droplet 42) can be filled into the actuator head 7. A water faucet 43 symbolizes the source of cleaning fluid.

Figure 7:
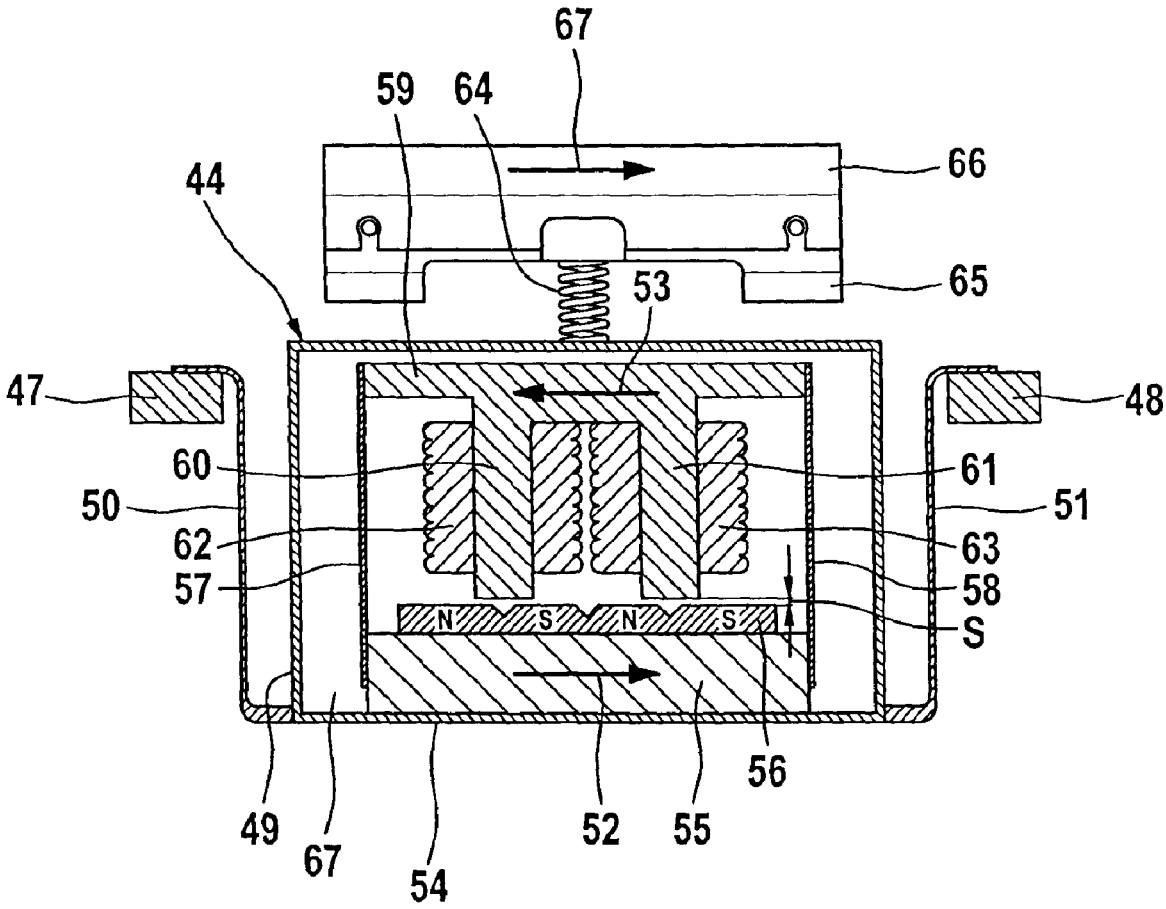
FIG. 7 is a schematic sectional representation of a linear motor that can be integrated, for example, in the interior of the actuator head shown in FIGS. 1 to 6.

Illustrated in FIG. 7 is finally another electric drive mechanism 79 that includes a linear drive motor 44. This linear drive motor 44 is also suitable, for example, for installing in the actuator head 7 of the shaving apparatus of FIGS. 1 to 6, whereby the shaded rectangles to the right and left of the linear drive motor 44 of FIG. 7 represent parts of the two side walls 47, 48 of the actuator head 7 that carry the linear drive motor 44, hereinafter referred to only as linear motor.

According to FIG. 7 the linear motor 44 includes a stator frame 49, which is constructed in the shape of a box and closed to be watertight, with external spring elements 50, 51 similar to leaf springs being fastened to both sides of the frame to serve as oscillating bridges. The spring elements 50, 51 have their other ends securely connected to the side walls 47, 48 of the actuator head 7. In this way the stator frame 49 can oscillate to and fro in the horizontal direction according to the arrows 52, 53. The external spring elements 50, 51 can be manufactured preferably from metal and can simultaneously provide the power supply for the linear motor 44. Fastened to the bottom of the stator frame 49 is a stator 55 with magnets 56 mounted on the upper side.

Extending upwards on the side walls of the stator 55 are respectively one oscillating spring 57, 58, said springs being connected with each other via a coil core 59. Extending downwards from the coil core 59 are two adjacent cylindrical core sections 60, 61, which are encompassed by respectively one annular coil 62, 63. The free ends of the core sections 60, 61 end a short distance from the magnets 56 on the stator 55, thus defining a predetermined gap S. The core sections 60, 61 are arranged such that each is arranged between a north pole and a south pole of the magnet 56. The north pole is indicated with N and the south pole with S in FIG. 7.

On the one hand the leaf springs 57, 58 of FIG. 7 establish the predetermined gap S and on the other hand they form the oscillating springs that are necessary for the resonance operating mode. However, the leaf springs 57, 58 could also be separate elements, such as for example compression springs, which can be inserted between the stator 55 and the core sections 60, 61.

The mode of operation of the shaving apparatus 1 of FIGS. 1 to 7 is as follows:

First it has to be decided which of the cutting systems 10, 26 is to be used. If the short-hair cutting system 10 (System 1) is to be used first, then there is no need to actuate the short-hair cutter button 19 because the shaving apparatus 1 of FIGS. 1 and 2 has already adopted this position, i.e., the two short-hair cutters 10, which extend side by side and parallel with each other, and the center cutter 23 arranged in between are already in the absolutely correct active plane 22.

According to FIGS. 1 and 2, the apparatus can now be switched on via the On/Off switch 13, and the electronic controller controls via power connections the linear motor 44 provided in the actuator head 7 (FIG. 7). Through the magnetic excitation of the coil core 59 and the core sections 60, 61 integrally formed therewith, by the coil 62, 63, there develops on the core sections 60, 61 an alternating magnetic field that causes said sections to oscillate relative to the stator 55. As the arrows 52 and 53 show, the core sections 60, 61 oscillate in opposite direction of the stator 55, whereby the stator frame 49 is set in oscillation by the acceleration forces, said motion being promoted by the spring elements 50, 51. The oscillating motion of the stator frame 49 is transmitted via the spring 64 onto the moving part 65 (blade block), which thus produces the shaving motion relative to the stationary part (shaving foil). A user can now slide the short-hair cutter 10 across the skin surface and cut off very fine hairs in the process.

The drive of the linear motor 44 operates in oscillating fashion at very high short-stroke frequencies, with the entire linear motor 44 being sealed in the stator frame 49. The actual oscillating shaving parts are arranged outside the stator frame 49 and as such can easily be cleaned with water without water being able to penetrate into the internal space 67 of the linear motor 44. It will be understood, of course, that it is possible, instead of coupling the shaving parts 65, 66 to the stator frame 49, to couple different types of drive elements directly and without sealing to various locations. Such drive elements can be, for example, long-hair cutters, short-hair cutters, center cutters and other actuator systems which can be driven via oscillating movements. If the user now wants to cut sideburns or head hair profiles, then according to FIG. 3 he must move the long-hair cutting system 26 into the active plane 22. This is done by actuating, according to FIGS. 1 and 2, the actuating button 20 for the long-hair cutting system (System 2). Using electric control means, the drive motor 14 is now set in rotation and for its part turns, via gearwheels 35, 36, 37 and the toothed belt 70, the actuator head 7 about its axis of rotation 8 until the long-hair cutter 26 has reached the active plane 22 according to FIG. 3. In this position, a position detector 38 sends an electric signal to the electronic components on the printed circuit board 33 so that the drive motor 14 switches off. To determine the correct position of the actuator head 7, windows 40 are evenly distributed over the circumference on the side wall 47 through which the position detector 38 detects the desired position of the actuator head 7 and sends this data to the electronic controller which then causes the electric motor 14 to be switched off.

The invention claimed is:

1. A hair removal apparatus, comprising:

(i) a housing;

(ii) an electric drive; and (iii) an actuator head comprising one or more hair removal regions, and one or more actuator systems each having a treatment plane, wherein:

(a) the actuator head is driven by the electric drive to engage and remove hairs;

(b) the actuator head is rotatable about an axis of rotation that extends within the actuator head, wherein the axis of rotation is substantially parallel to a longitudinal axis of the hair removal region;

(c) the actuator head is attached to the housing at only one end of the head, from which end the head extends across the housing;

(d) the actuator head is a rotary body comprising an end face arranged perpendicularly to the axis of rotation and rotatably coupled to an arm, in which the hair removal regions are spaced about a circumference of the end face; and (iv) an electrically driven adjusting unit configured to rotate the actuator head about the axis of rotation;

wherein the housing comprises the arm that extends transversely to the axis of rotation, wherein one end of the hair removing head is coupled to the arm; and wherein an opening for the actuator head is defined along a longitudinal axis of the actuator head.

2. The hair removal apparatus of claim 1, wherein the electrically driven adjusting unit comprises an additional electrically driven motor and a transmission arranged to turn the actuator head such that one of the hair removal regions is in an active position.

3. The hair removal apparatus of claim 2, further comprising an electrically operated position detector configured to monitor a rotary position of the actuator head and to control the additional electrically driven motor.

4. The hair removal apparatus of claim 3, wherein the electric drive comprises a linear motor, the actuator head further comprises an actuator housing, and the linear motor is arranged in the housing of the actuator head.

5. The hair removal apparatus of claim 4, further comprising a sealed stator frame coupled to the actuator head to allow oscillatory movement of the stator frame with respect to the actuator head, wherein the linear motor is enclosed in the stator frame.

6. The hair removal apparatus of claim 5, wherein the linear motor comprises:

(a) a stator, the stator comprising magnets; and (b) an armature, the armature comprising coils;

wherein the armature is movably coupled to the stator, and the hair removal region is movably coupled to the stator frame and fixedly coupled to the housing of the actuator head.

* * * * *